United States Patent [19]

Ragoza et al.

[11] 4,316,369

[45] Feb. 23, 1982

[54] CIRCULAR WARP KNITTING MACHINE

[76] Inventors: Igor V. Ragoza, prospekt Chernyakhovskogo, 26, kopus 3, kv. 56, Vitebsk; Alexandr S. Dalidovich, Leningradskoe shosse, 122, kv. 206, Moscow; Petr M. Begunov, Moskovsky prospekt, 7, kv. 114; Petr J. Vasiljuk, ulitsa Shirokaya, 30, kv. 5, both of Vitebsk; Robert T. Tonikian, ulitsa Chkalova, 11, korpus 12, kv. 79; Dina N. Tonikian, ulitsa Chkalova, 11, korpus 10, kv. 92, both of Vitebsk; Alexandr V. Makarenko, ulitsa Chkalova, 11, korpus 10, kv. 92, Vitebsk, all of U.S.S.R.

[21] Appl. No.: 92,414

[22] Filed: Nov. 9, 1979

[51] Int. Cl.[3] ..... D04B 25/02

[52] U.S. Cl. ..... 66/81; 66/104

[58] Field of Search ..... 66/5, 81, 104, 135

[56] References Cited

U.S. PATENT DOCUMENTS

| | | | |
|---|---|---|---|
| 291,377 | 1/1884 | Merrow | 66/104 X |
| 670,497 | 3/1901 | Hill | 66/81 |
| 1,005,720 | 10/1911 | Lawrence | 66/81 |
| 3,522,715 | 8/1970 | Merritt et al. | 66/5 |

FOREIGN PATENT DOCUMENTS

| | | | |
|---|---|---|---|
| 2045281 | 3/1972 | Fed. Rep. of Germany | 66/104 |
| 360418 | 1/1973 | U.S.S.R. | 66/5 |
| 388067 | 6/1973 | U.S.S.R. | 66/5 |
| 490885 | 1/1976 | U.S.S.R. | 66/81 |
| 529270 | 11/1976 | U.S.S.R. | 66/81 |

*Primary Examiner*—Wm. Carter Reynolds

*Attorney, Agent, or Firm*—Steinberg & Raskin

[57] ABSTRACT

A circular warp knitting machine is designed for knitting hosiery pieces and comprises a stationary needle cylinder, knitting needles which are installed in grooves of two concentrically arranged annular guide bars, racking mechanisms for racking the guide bars together with the guide needles along the front of the knitting needles and rocking mechanisms for rocking the guide needles between the knitting needles. The needle cylinder accomodates a sleeve movable therealong which controls the movement of the sinkers. A holder movable along the needle cylinder is arranged inside the needle cylinder and carries the knitting needles mounted therein, and sliding frames of the rocking mechanisms of the guide needles and concentrically arranged rotatable casings carrying the annular guide bars are installed over the needle cylinder coaxially therewith. This arrangement ensures a simple and compact structure of the machine.

5 Claims, 9 Drawing Figures

CIRCULAR WARP KNITTING MACHINE

The invention relates to knitwear manufacture, and more particularly, to circular warp knitting machines for knitting hosiery pieces.

Known in the art are circular warp knitting machines having frontally movable knitting needles, thread guide rings being installed outside the knitting needles to lay warp threads on the needles only due to their racking movement along the front of the knitting needles. The stitch-forming process in such machines is, however, imperfect, and patterns capabilities are limited compared to flat warp knitting machines.

Known in the art are methods for knitting hosiery pieces on circular warp knitting machines (cf. USSR Inventor's Certificates Nos. 360418, 388067).

Each method is simple enough, ensures reliable stitch formation and enables the manufacture of hosiery pieces with various patterns.

A circular warp knitting machine for carrying out this method comprises a stationary needle cylinder and stitch-forming members, knitting (flap) needles which are caused to reciprocate vertically, radially movable sinkers installed in grooves of a sinker cup mounted inside the needle cylinder, and two sets of guide needles installed in grooves of two concentrically arranged annular guide bars. The knitting needles are arranged around the needle cylinder and the sinkers have their butts received in an annular cam. The guide needles of each set also have their butts received in annular cams.

The machine also has racking mechanisms for racking the guide bars together with the guide needles along the front of the knitting needles and rocking mechanisms for each set of the guide needles for rocking them between the knitting needles, both mechanisms being operatively connected to the main shaft.

It is an object of the invention to provide a circular warp knitting machine which has a simple and compact structure.

Another object of the invention is to provide a circular warp knitting machine, wherein the mechanisms imparting motion to the stitch-forming members (knitting needles, sinkers and sets of guide needles) ensure a reliable stitch-forming process.

With these and other objects in view in a circular warp knitting machine comprising a stationary needle cylinder, knitting needles which are caused to reciprocate vertically and which are arranged around the needle cylinder, radially movable sinkers having butts thereof received in an annular cam and installed in grooves of a sinker cup mounted inside the needle cylinder, two sets of guide needles having their butts received in annular cams and installed in grooves of two concentrically arranged annular guide bars, the guide needles being operatively connected to a main shaft of the machine, racking mechanisms for racking the guide bars together with the guide needles along the front of the knitting needles and rocking mechanisms of each set of the guide needles for rocking them between the knitting needles, according to the invention, the needle cylinder has in the interior thereof a sleeve which is movable therealong and has at the upper portion thereof an annular cam for the butts of the sinkers, the lower portion of the sleeve being operatively connected to the main shaft of the machine for imparting radial motion to the sinkers, a holder is installed outside the needle cylinder for movement therealong, connected to a mechanism causing the knitting needles to move vertically and carries the knitting needles installed therein, and sliding frames of the rocking mechanisms of the guide needles carrying annular cams for butts of the guide needles carrying annular cams for butts of the guide needles and concentrically arranged casings carrying the guide bars and operatively connected to the racking mechanisms are installed over the needle cylinder coaxially therewith.

This arrangement of the mechanisms in a circular warp knitting machine ensures a reliable stitch-forming process and stable movement of the needles, sinkers and guide needles thus enabling the maintenance of a constant pre-set speed of the machine and its high output.

According to the invention, the sleeve is installed in a cylindrical guide which is formed by the needle cylinder and a tube secured to the machine bed and supporting a sinker funnel, and the operative connection of the sleeve to the main shaft of the machine includes a frame installed on the main shaft for rotation relative thereto, links articulated to the sleeve and to the frame and a double-arm lever having one arm which is articulated to the frame by means of a rod and the other arm permanently engaging a member imparting motion to the sinkers which is mounted on the main shaft, all articulation joints of the frame and double-arm lever being adjustable and both the links and the rods being of adjustable length. This improves stability of sinkers in operation and enlarges the range of adjustment of the sinkers size.

According to the invention, the holder carrying the knitting needles is formed by two concentrically arranged sleeves, the outer sleeve having an annular groove to receive butts of the knitting needles, and the inner sleeve having grooves to receive shanks of the knitting needles.

The invention is characterized in that the holder comprises two longitudinally extending portions, and the mechanism imparting vertical motion to the knitting needles comprises a crank gear, a rotatable frame connected to a crankshaft of the crank gear which is installed on the main shaft of the machine, and legs mounted on the rotatable frame, each leg being coupled to the respective part of the holder by means of a link and a rod which are articulated to one another, the leg associated with one portion of the holder being installed on the rotatable frame by means of a sliding key and having a device for moving it along the rotatable frame.

Owing to an independent drive of each portion of the holder hosiery pieces of any curved shape may be made.

The invention is also characterized in that the device for moving the leg along the rotatable frame comprises a drive shaft which is connected to the main shaft of the machine by means of a gear train and a Geneva mechanism having its drive wheel secured to the drive shaft and a shaft of a driven wheel having a cam controlling the movement of the leg by means of a double-arm lever engaging the cam, a link which is operatively connected to the rotatable frame and a rocking slot hole member having its slider which comprises a pin secured to the leg, the leg being elastically biased against a stop secured to the rotatable frame.

This arrangement of the device enables a very rapid disengagement of a part of the needles.

The invention is further characterized in that the sliding frame of each rocking mechanism of the guide needles is installed in guides of the bed and is articulated by means of a link, an arm and a connecting rod to a motion imparting member of the rocking mechanism of the guide needles installed on a drive shaft thereof, the articulation joints connecting the arm to the bed and to the link being adjustable.

Each rocking mechanism of the guide needles preferably has a device for retaining the guide needles in the grooves of the guide bar, the device for retaining the guide needles in the inner guide bar comprising a spring-biased plate secured to a fixed axle coaxially with the inner annular guide bar and having its edge bearing against a toroidal surface of the annular guide bar, and the device for retaining the guide needles in the outer guide bar comprising two superposed rings embracing the guide bar, each ring having internally a toroidal surface and externally an arm, the arms of both rings interconnected by springs thereby ensuring an elastic bias of the rings against one another and against the toroidal surface of the outer guide bar. This arrangement ensures reliable retaining of the guide needles against leaving the grooves of their respective guide bars without hampering the the racking movement of the guide bars.

The invention is further characterized in that the rotatable casings are installed in the bed guides and are articulated by means of a link to racking mechanisms, each racking mechanism comprising a cam with change cam plates which is installed on a drive shaft, and a spring-biased double-arm lever having a roller at one arm to engage the cam and connected with the other arm thereof to the link, the cam being formed by a sleeve integral with a plate to which the change cam plates are adjustably secured, one of the cam plates which has a greater radius of the working surface having a projection and consisting of two portions having radially mating planes thereof which are parallel and extend at an angle to the axis of the drive shaft so that the projection of one portion of the cam plate can be brought in the zone of the projection of the other portion of the cam plate.

The invention will now be described in detail with reference to the accompanying drawings showing a specific embodiment of the invention, in which:

FIG. 1 schematically shows, in a longitudinal section, the relative arrangement of stitch-forming members of a circular warp knitting machine and a kinematic diagram of the sleeve movement;

Figure 8:
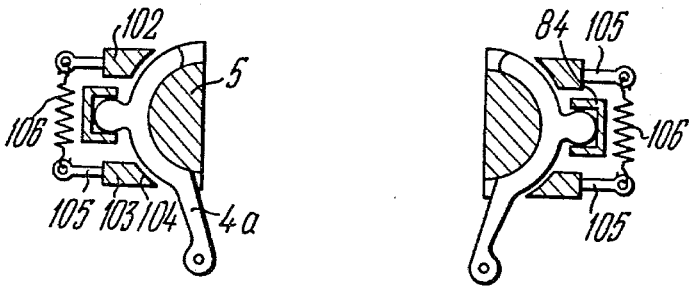
Figure 9:
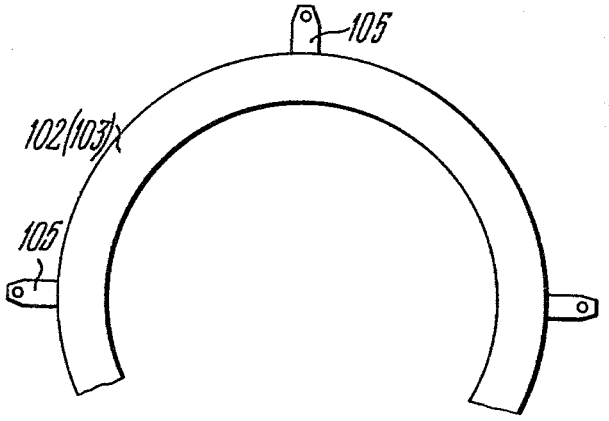

FIG. 8 schematically shows the device retaining guide needles in the outer guide bar in section along the guide needles;

FIG. 9 shows a portion of the ring of the device shown in FIG. 8.

Figure 7:
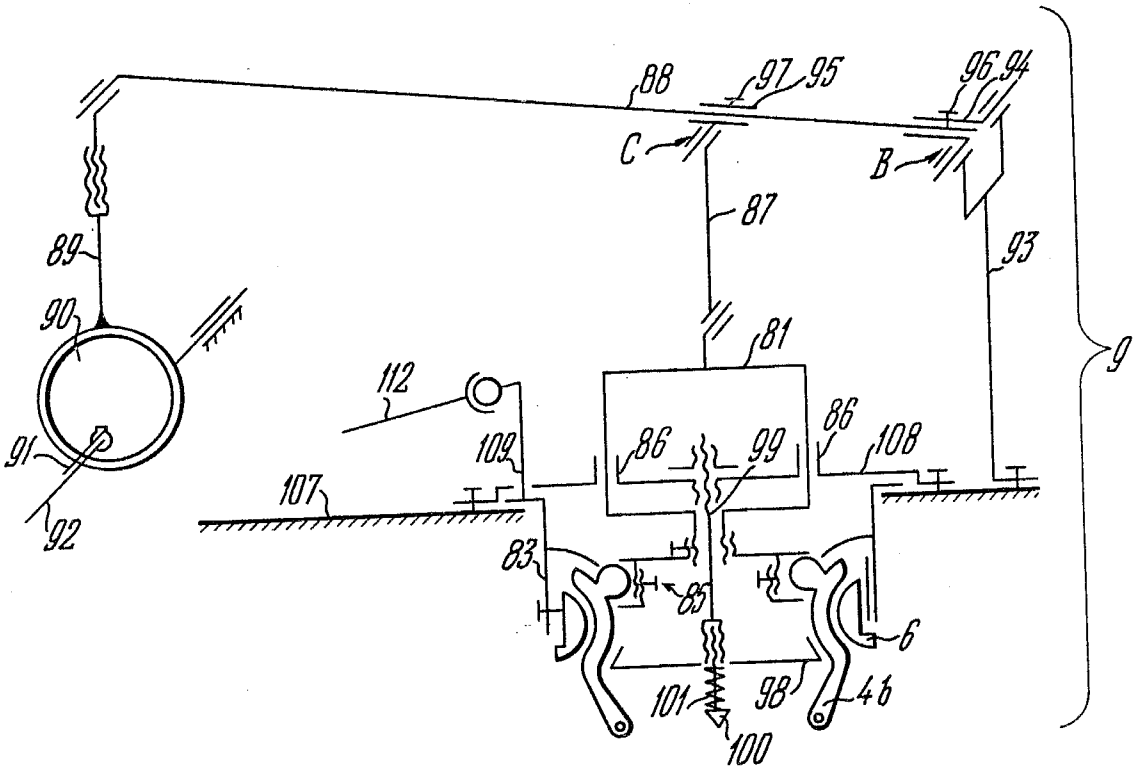
FIG. 7 is a kinematic diagram of the rocking mechanism of guide needles.

A circular warp knitting machine comprises a stationary needle cylinder 1 (FIG. 1), knitting needles 2 which are vertically reciprocated, radially movable sinkers 3, two sets of guide needles *4a* and *4b* for laying two systems of warp threads on the knitting needles 2 installed in grooves of two concentrically arranged annular guide bars 5 and 6, respectively, a mechanism 7 (FIG. 2) for vertically moving the knitting needles, racking mechanisms 8 (FIGS. 3 through 6) for racking the guide bars 5 and 6 together with the guide needles along the front of the knitting needles 2, rocking mechanisms 9 (FIG. 7) for rocking each set of guide needles between the knitting needles 2 and a control drum of a control device of the machine of any known design (not shown). It is understood that, in addition to the above-mentioned mechanisms, the circular warp knitting machine is provided with all necessary devices and mechanisms of known type ensuring the stitch-forming process to occur automatically.

The radially movable sinkers 3 (FIG. 1) are crescent-shaped and have their butts 10 received in an annular cam 11. The sinkers 3 are installed in grooves 12 of a sinker cup 13 which is secured to the needle cylinder.

The needle cylinder 1 accommodates a sleeve 14 which is movable therealong, having the annular cam 11 at the upper portion thereof and is operatively connected with its lower portion to a main shaft 15 of the machine for imparting radial motion to the sinkers 3. The sleeve 14 is installed in a cylindrical guide which is formed by the needle cylinder 1 and a tube 16 arranged inside the needle cylinder coaxially therewith and secured to bed 17 of the machine by means of pins 18 passing through longitudinal holes of the sleeve 14. A sinker funnel 19 is secured to the upper portion of the tube 16 and retains the sinkers 3 in the grooves 12 of the sinker cup 13, a hosiery piece which is knit being withdrawn through the funnel 19 and the tube 16.

Figure 1:
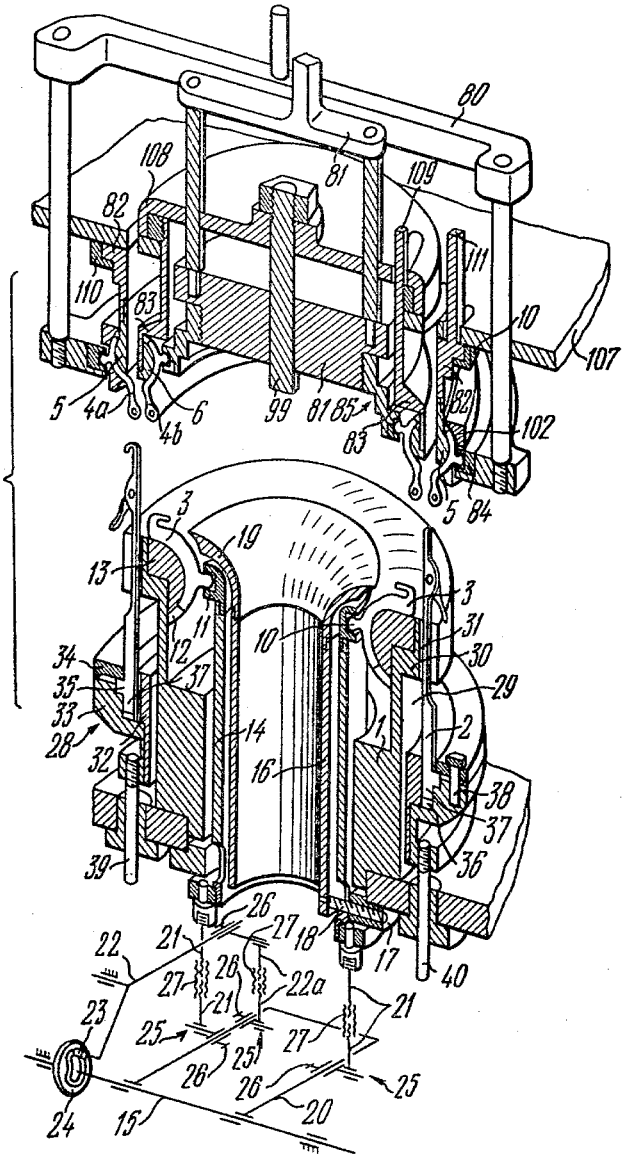
Figure 2:
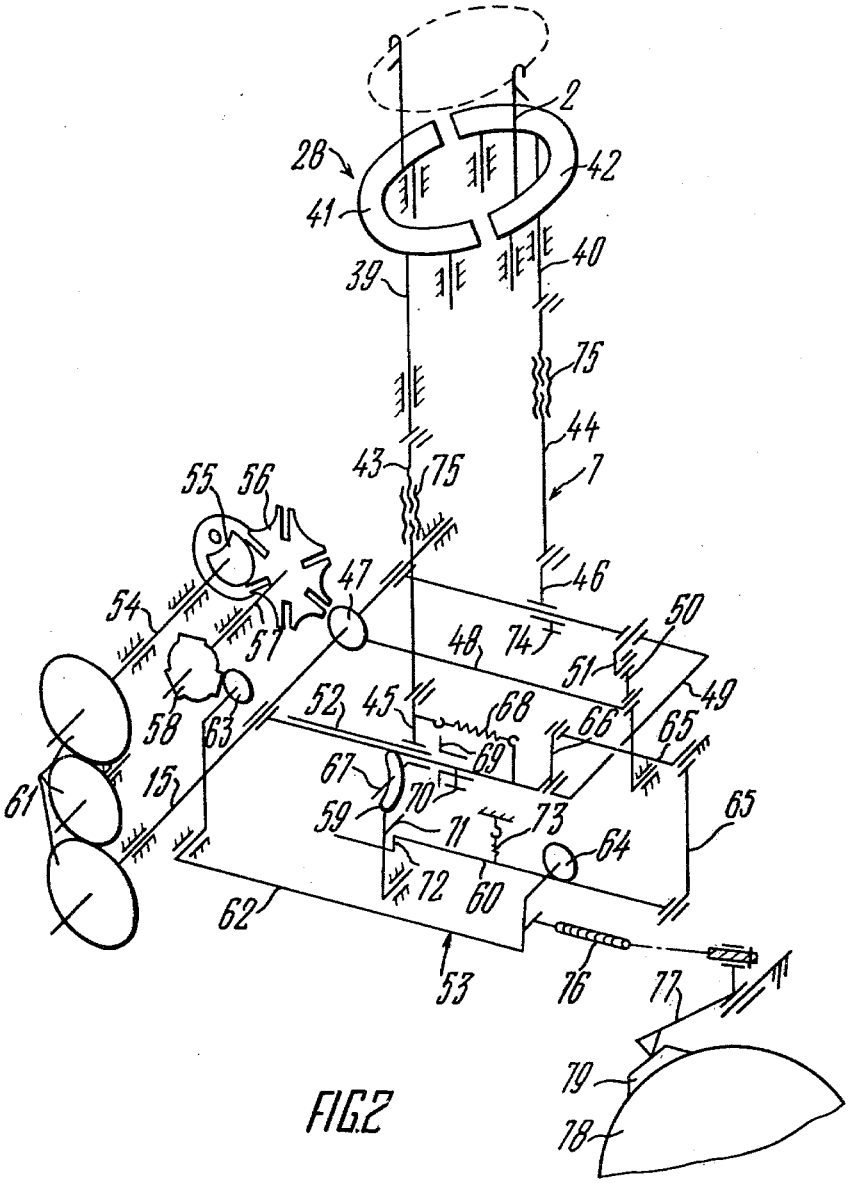
FIG. 2 shows a kinematic diagram for moving knitting needles.

The operative connection of the sleeve 14 to the main shaft 15 of the machine includes a frame 20 which is rotatably mounted on the main shaft 15, links 21 articulated to the sleeve 14 and to the frame 20, and a double-arm lever 22. One arm of the double-arm lever 22 permanently engages, through a roller 23, a cam 24, that is the member imparting motion to the sinkers 3 and determining the displacement of the sleeve 14 along the needle cylinder. The cam 24 is installed on the main shaft 15. The other arm of the lever 22 is articulated to the frame 20 by means of a rod *22a*. Articulation joints 25 which connect the frame 20 to the links 21 and to the rod *22a*, and the rod *22a* to the double-arm lever 22, are adjustable. For that purpose, the articulation joints comprise sliders secured by means of screws 26 to the frame 20 and to the double-arm lever 22. The links 21 and the rod *22a* are of adjustable length, and for that purpose, each of them is made of two portions (as shown in FIG. 1) interconnected by means of a nut 27.

Installed outside the needle cylinder 1 is a holder 28 which is movable therealong, connected to the mechanism 7 for vertically moving the knitting needles 2 and carries the knitting needles 2 mounted therein, the holder 28 being movable along a smooth surface 29 of the needle cylinder 1 having at the top thereof an annular projection 30 with grooves 31 for knitting needles.

The holder 28 is formed by two concentrically arranged sleeves 32 and 33 and a pressure ring 34.

The inner sleeve 32 directly abuts against the smooth surface 29 of the needle cylinder 1, and the outer sleeve 33 embraces the inner sleeve 32 and has internally an annular groove to receive butts 35 of the knitting needles 2. The inner sleeve 32 has on its side facing the outer sleeve 33 grooves 36 to receive shanks 37 of the knitting needles 2.

The pressure ring 34 is secured to the end face of the outer sleeve 33 by screws 38 and is designed for retaining the knitting needles 2 in the grooves 36.

The holder 28 (FIG. 2) is installed on rods 39 and 40 of the mechanism 7 for moving the knitting needles, and the holder 28 may be made of two longitudinally extending portions 41 and 42 so that one of the parts may be disengaged if necessary.

The portion 41 of the holder is installed on the rod 39, and the portion 42 of the holder is installed on the rod 40, the rods 39 and 40 being connected, by means of links 43 and 44, respectively, to legs 45 and 46 of the mechanism 7 for moving the knitting needles.

The mechanism 7 for moving the knitting needles comprises; a crank gear consisting of a crankshaft 47 mounted on the main shaft 15 of the machine and a connecting rod 48; a rotatable frame 49 connected to the crankshaft 47; the legs 45 and 46 installed on the rotatable frame 49.

The rotatable frame 49 is mounted with the ends thereof on the main shaft 15 by means of bushings and is articulated to the connecting rod 48 by means of a link 51 and an arm 50 mounted on the bed, the bushings being rotatable on the main shaft 15.

The leg 45 of the portion 41 of the holder is installed on the rotatable frame 49 by means of a sliding key 52 and has a device for moving the leg 45 along the frame 49. The device 53 comprises a drive shaft 54; a Geneva mechanism comprising a drive wheel 55 secured to the drive shaft 54 and a driven wheel 56 secured to a shaft 57 having a cam 58; a rocking slot hole member 59 and a link 60.

The drive shaft 54 is connected by means of a gear train 61 to the main shaft 15 of the machine.

The cam 58 is designed for controlling the displacement of the leg 45 by means of a double-arm lever 62 which engages, through a roller 63, the cam 58 and, through a roller 64, the link 60, the link 60 being operatively connected to the rotable frame 49 by means of a double-arm lever 65 and a link 66.

A slider of the rocking slot hole member 59 comprises a pin 67 and is secured to the leg 45, the leg 45 being biased by a spring 68 against a stop 69 secured to the frame 49 by a screw 70.

The rocking slot hole member 59 has a pin 71 engageable with a stop 72 of the link 60, the link 60 being permanently biased by a spring 73 against the roller 64.

The leg 46 of the portion 42 of the holder is secured to the frame 49 by a screw 74, the screws 74 and 70 being designed for adjusting the position of the leg 46 and the stop 69 along the lateral sides of the frame 49 so as to vary the amount of vertical displacement of the portions 41 and 42 of the holder.

The links 43 and 44 are of adjustable length, that is each link consists of two portions interconnected by means of a nut 75 so as to adjust the relative position of the two portions 41 and 42 of the holder.

The double-arm lever 62 is connected to a control drum 78 of the control device of the machine having a strap 79 for controlling the device 53 by means of a rope 76 and a double-arm lever 77.

Mounted over the needle cylinder 1 (FIG. 1) coaxially therewith there are sliding frames 80 and 81 of the rocking mechanisms 9 of the guide needles **4*a* and 4*b*, respectively, and concentrically arranged rotatable casings 82 and 83 carrying the guide bars 5 and 6, respectively, and operatively connected to the racking mechanisms 8**.

To simplify the description, the rocking mechanisms 9 and the racking mechanisms 8 are only shown for the guide needles **4*b* of the inner guide bar 6**.

For each rocking mechanism of the guide needles, annular cams 84 and 85 are secured to the sliding frames 80 and 81, respectively, to receive butts of the guide needles **4*a* and 4*b***.

The sliding frame 81 (FIG. 7) is installed in guides 86 of the bed and is articulated by means of a link 87, an arm 88 and a connecting rod 89 to a motion imparting member of the rocking mechanism 9 of the guide needles—an eccentric 90. An eccentric 90 is installed on a drive shaft 92 by means of a key 91. Articulation joints B and C which connect the arm 88 to an upright 93 of the bed and to the link 87, respectively, have sleeves 94 and 95 secured to the arm 88 by screws 96 and 97, respectively, for their adjustment.

Each rocking mechanism 9 of the guide needles has a device for retaining the guide needles in grooves of the annular guide bar. Thus, for the inner annular guide bar 6 this device comprises a spring-biased plate 98 which is secured to a fixed axle 99 coaxially with the inner annular guide bar 6. The plate 98 bears with the edge thereof against a toroidal surface of the annular guide bar 6.

The plate 98 is secured to the axle 99 by a screw 100 through a spring 101.

For the outer guide bar 5 (FIG. 8), the device for retaining the guide needles **4*a* comprises two superposed rings 102 and 103 (FIG. 9) embracing the guide bar 5 (FIG. 8), and each ring 102, 103 has internally a toroidal surface 104 and externally arms 105, the arms 105 of both rings 102, 103 being interconnected by springs 106 so as to ensure an elastic bias of the rings 102 and 103 against one another and against the toroidal surface of the guide bar 5**.

The rotatable casing 83 (FIG. 1) carrying the inner guide bar 6 is installed in a guide which is formed by a plate 107 of the bed and an end plate 108 and has a projection 109, and the rotatable casing 82 carrying the outer guide bar 5 is installed in a guide formed by the plate 107 of the bed and a ring 110 and has a projection 111.

The rotatable casing 83 with the projection 109 is articulated by means of a link 112 (FIGS. 3 and 7) to the racking mechanism 8 of the inner guide bar.

Each racking mechanism 8 (FIG. 3) comprises a cam 113 which is installed in a drive shaft 114 (FIG. 4) and a spring-biased double-arm lever 115 (FIG. 3) having a roller 116 at one arm thereof for engaging the cam 113, the other arm of the lever being connected to the link 112.

Figure 3:
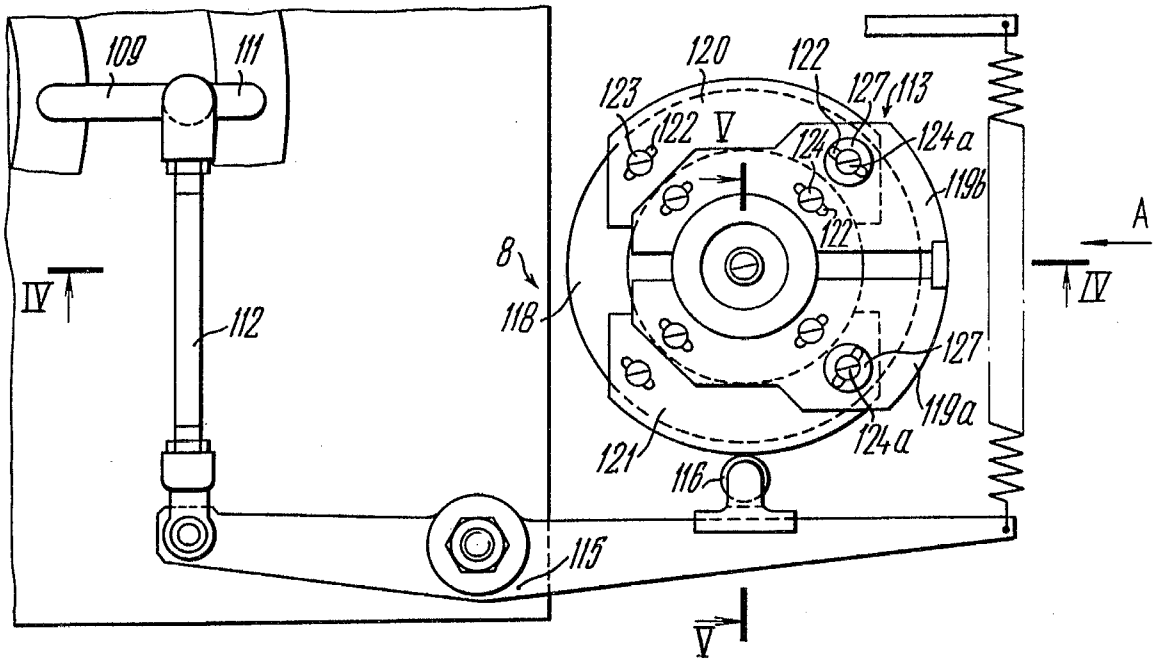
FIG. 3 shows a kinematic diagram of the racking mechanism in a plan view.
Figure 4:
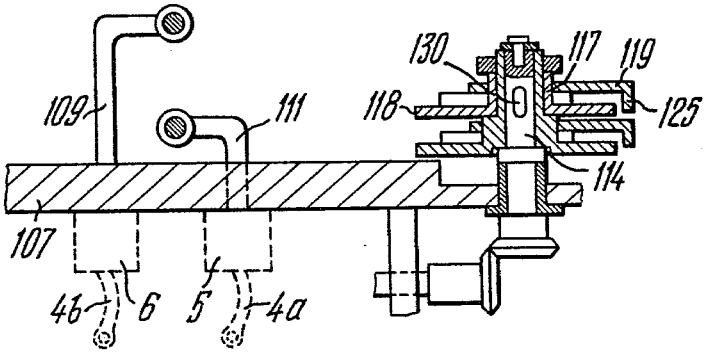
FIG. 4 is a sectional view taken along the line IV—IV in FIG. 3.
Figure 5:
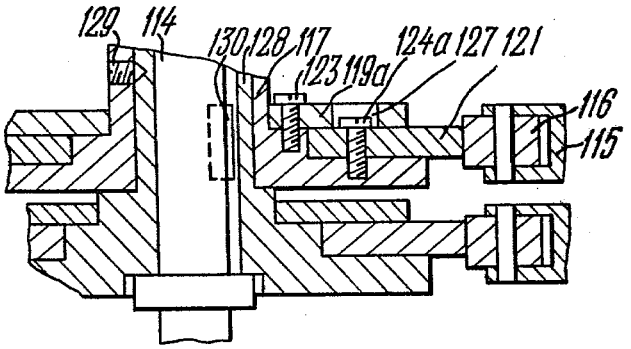
FIG. 5 is a sectional view taken along the line V—V in FIG. 3.
Figure 6:
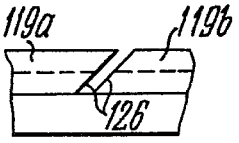
FIG. 6 is a view of a cam plate taken along arrow VI in FIG. 3 (turned at 90°)

The cam 113 is formed by a sleeve 117 (FIG. 4) which is integral with a plate 118 to which are adjustably secured change cam plates 119, 120 (FIG. 3), 121. For that purpose, the change cam plates have slot holes 122 with screws 123 for securing the change cam plates 120 and 121 and screws 124 and **124*a* for securing the cam plate 119. The cam plate 119 has a radius of the working surface which is greater than the radius of the cam plates 120 and 121 and has a projection 125 (FIG. 4). The cam plate 119 is made of two portions 119*a* and 119*b* (FIG. 3) which are so arranged that their radially mating surfaces 126 (FIG. 6) are parallel and extend at an angle to the axis of the drive shaft 114, whereby the projection 125 one portion 119*a* of the cam plate can be brought in the zone of the projection of the other portion 119*b*** of the cam plate. The portions of the cam plate 119 have enlarged holes 127 in the zone of the screws 124*a* (FIGS. 3 and 5).

The projection 111 (FIGS. 1 through 4) of the rotatable casing 82 is similarly connected to the racking mechanism 8 of the other guide bar 5. For a compact arrangement of the racking mechanisms 8 of the guide bars 5 and 6, the sleeve 117 (FIG. 5) is installed on a sleeve 128 and is secured thereto by a lock screw 129, and the sleeve 128 is installed on the drive shaft 114 by means of a sliding key 130.

The circular warp knitting machine according to the invention functions in the following manner.

The knitting needles 2 (FIGS. 1 and 2) are caused to reciprocate vertically by the main shaft 15. The eccentric 47 (FIG. 2) of the shaft 15 causes oscillations of the rotatable frame 49 through the connecting rod 48, arm 50 and link 51 so that one side of the frame imparts motion through the leg 46 and link 44 to the rod 40 carrying the portion 42 of the holder 28 with the knitting needles, and the other side of the frame 49 imparts motion through the leg 45 and link 43 to the rod 39 carrying the portion 41 of the holder 28 with the knitting needles 2.

When stitches are formed at all knitting needles 2 in making a hosiery piece, both portions 41 and 42 of the holder 28 are caused to move by the same amount. In this operation mode the leg 45 is fixed relative to the rotatable frame 49 since the spring 68 urges it against the stop 69. The slider 67 fixed to the leg 45 moves within the rocking slot hole member 59.

The rotatable frame 49 permanently imparts motion to the link 60 with the stop 72 through the link 66 and the double-arm lever 65. When both portions 41 and 42 of the holder 28 operate identically, the link 60 is urged by the spring 73 against the roller 64 installed at the end of the double-arm lever 62. The lever 62 with the rope 76 and arm 77 bearing against the strap 79 of the control drum 78 of the control device of the machine is fixed in such a manner that the roller 64 holds the link in the lower position. The projection 72 does not engage the pin 71 and moves therebelow, and the roller 63 of the lever 62 is at the level of the lobes of the cam 58 without engaging them.

The cam 58 receives at regular intervals rotary pulses from the uniformly rotating main shaft 15 through the gear train 61, drive shaft 54, Geneva mechanism 55, 56 and shaft 57.

To switch the machine for making a curved hosiery piece, a part, e.g. the part 41 of the holder 28 with the knitting needles 2 is disengaged from the rotatable frame 49 as described below, and the part 42 of the holder 28 continues to move as before. For switching over, the control drum 78 of the control device of the machine is caused to rotate, the arm 77 is disengaged from the strap 79 and releases the rope 76 and the double-arm lever 62. At this moment a lobe of the cam 58 is opposite the roller 63. The spring 73 acts, through the link 60, on the roller 64 and urges the roller 63 against the cam 58 through the double-arm lever 62. Subsequently, during operation, when a depression of the cam 58 is opposite the roller 63, the lever 62 releases the link 60 and the spring 73 lifts it, the projection 72 engages the pin 71, and the double-arm lever 62 turns so that the roller 63 is received in the depression of the cam 58. When the rotatable frame 49 moves up, the link 60 acts with the projection 72 thereof on the pin 71 to turn the rocking slot hole member 59 towards the main shaft 15. The rocking slot hole member 59 acts on the slider 67 to move the leg 45 along the sliding key 52 of the rotatable frame 49 toward the main shaft 15. The portion 41 of the holder 28 with its knitting needles 2 is not lifted, the needles do not receive threads and do not form new stitches. When the rotatable frame 49 moves down, the link 60 moves away from the main shaft 15 to release the rocking slot hole member 59 and the slider 67 with the leg 45, and the spring 68 causes them to move in the same direction up to the stop 69. The portion 42 of the holder 28 is not disengaged, and upon any oscillation of the frame 49 threads are laid on its warp threads and an incomplete course is made. The number of incomplete courses depends on the time during which the depression of the cam 58 is opposite the roller 63.

When the Geneva mechanism 55, 56 causes rotation of the cam 58 through the shaft 57, a lobe of the cam 58 gets opposite the roller 63 so as to turn the lever 62, and the roller 64 causes the link 60 to move down. The projection 72 of the link is thus disengaged from the pin 71, and the portion 41 of the holder 28 starts moving identically with the portion 42, so that complete annular courses are made at all needles of the cylinder. The number of complete annular courses depends on the time during which the lobe of the cam 58 is opposite the roller 63.

Upon every next passage of one depression and one lobe of the cam 58 by the roller, the above-described cycle of making incomplete and complete courses is repeated.

After the curved portion of a hosiery piece is knit, the machine is switched for making the cylindrical portion, and for that purpose the control drum 78 of the control device of the machine is caused to rotate. The strap 79 engages the arm 77 to turn it, and the rope 76 acts on the lever 62 so that the roller 64 will fix the link 60 in the lower inoperative position, while the roller 63 is disengaged from the cam 58. The control drum 78 is caused to turn for making the curved portion of a hosiery piece and for switching over for making the cylindrical portion at a moment when a lobe of the cam 58 is opposite the roller 63.

In knitting both curved hosiery piece and cylindrical pieces the sinkers 3 (FIG. 1) and the guide bars 4*a* and 4*b* continue to move.

The radial movement of the sinker 3 in the grooves of the sinker cup 13 is caused by the main shaft 15 by means of the cam 24, roller 23, double-arm lever 22, rod 22*a*, rotatable frame 20, links 21, sleeve 14 and annular cam 11 which receives the butts 10 of the sinkers 3. The sleeve 14 moves steadily within the cylindrical guide formed by the inner surface of the cylinder 1 and the outer surface of the tube 16.

Radial movement of the guide needles 4*a* in the grooves of the outer guide bar 5 and of the guide needles 4*b* in the grooves of the inner guide bar 6 is caused by the drive shaft 92 (FIG. 7) by means of identical rocking mechanisms 9.

Rotary motion is transmitted from the shaft 92 through the key 91 to the eccentric 90. The motion is transmitted from the eccentric 90 through the connecting rod 89, arm 88, link 87 and sliding frame 81 to the annular cam 85 which acts on the butts of the guide needles 4*b* to impart radial rocking movement thereto in the grooves of the guide bar 6. The guide needles 4*b* are retained within the grooves of the guide bar 6 by the plate 98 which is urged against the toroidal surface of the guide bar 6 by the screw 100 through the spring 101 which prevents inadvertent loosening of the screw 100 during the rocking movement of the guide bar along the front of the knitting needles.

The guide needles 4*a* are retained within the grooves of the outer guide bar 5 (FIG. 8) by means of the two rings 102 and 103 which are urged with their inner toroidal surfaces 104 against the outer surface of the guide bar 5 by means of the springs 106.

The racking motion along the front of the knitting needles 2 is imparted to the guide needles 4*b* (FIG. 1) and to the guide bar 6 which is secured to the rotatable casing 83. The rotatable casing 83 with the guide bar 6 is caused to move by the racking mechanism 8 (FIG. 3) in which the drive shaft 114 (FIG. 4) permanently imparts rotary motion to the cam 113 (FIG. 3). The cam 113 imparts motion through the roller 116 to the spring-biased lever 115, and the latter transmits this motion to the rotatable casing 83 through the link 112 and the projection 109.

Similarly the identical racking mechanism 8 ensures the movement of the guide needles 4*a* with the guide bar 5 and the rotatable casing 82 carrying it.

The movement of all stitch-forming members—knitting needles 2, sinkers 3, guide bars 4*a* and 4*b*—is adjustable.

The stroke of the sinkers 3 is adjusted by displacing the articulation joints 25 along the sides of the frame 20 and along the lever 22, with subsequent locking by the screw 26.

The path of movement of the guide needles may be displaced with respect to the front of the knitting needles 2 by adjusting the length of the rod 22*a* and the link 21 using the nuts 27.

The stroke of the knitting needles 2 (FIG. 2) secured to the part 42 of the holder 28 is adjusted by displacing the leg 46 along the side of the frame 49 with subsequent locking by the screw 74. The stroke of the knitting needles 2 secured to the part 41 of the holder 28 is adjusted by displacing the stop 69 along the side of the frame 49, with subsequent locking by the screw 70. The path of movement of the knitting needles may be vertically adjusted by changing the length of the links 43 and 44 by means of the nuts 75.

The radial rocking stroke of the guide needles 4*b* (FIG. 7) may be adjusted by relative displacement of the articulation joints C and B and arm 88 within the bushings 95 and 94, with subsequent locking by the screws 97 and 96, respectively, on the arm 88. The rocking path of the guide needles is changed by adjusting the length of the connecting rod 89 which consists of two parts threaded together. The stroke adjustment is also provided for the guide needles 4*a* (not shown in FIGS. 1 and 7).

Relative position of the guide needles along the front of the knitting needles 2 (FIG. 3) is changed by changing the length of the link 112, and the timing of the racking motions is adjusted by displacing the change cam plates 119, 120 and 121 with respect to the sleeve 117, with subsequent locking by the screws 124*a* and 124. The cam plate 119 has an individual adjustment for each portion 119*a* and 119*b* thereof.

What is claimed is:

1. A circular warp knitting machine comprising: a bed; a needle cylinder fixedly mounted on said bed; knitting needles which are caused to reciprocate vertically arranged around said needle cylinder; a mechanism for vertically moving said knitting needles; a holder movable along said needle cylinder connected to said mechanism for vertically moving the knitting needles; said holder being arranged outside said needle cylinder and carrying said knitting needles mounted therein; a main shaft of the machine; radially movable sinkers having butts; an annular cam, the butts of said sinkers being received in said annular cam; a sinker cup installed inside said needle cylinder and having grooves accommodating said sinkers; a sleeve movable along said needle cylinder, said sleeve being arranged inside the needle cylinder and carrying in the upper portion thereof said annular cam receiving the butts of the sinkers, a tube installed on said bed inside the needle cylinder, the tube forming with the needle cylinder a cylindrical guide in which said sleeve is installed and said tube having a sinker funnel secured in an upper portion thereof, the lower portion of the sleeve being connected to said main shaft of the machine to impart radial motion to the sinkers, said connection of the sleeve to the main shaft of the machine including a frame mounted on said main shaft for rotation relative thereto, links articulated to said sleeve and to said frame, and a double-arm lever having one arm articulated by means of a rod to said frame, the other arm of the lever permanently engaging a member mounted on said shaft for imparting motion to said sinkers and wherein articulation joints connect the frame to said links and said rod to said double-arm lever, said articulation joints being adjustable with said links and said rod being of adjustable length; two sets of guide needles having butts; annular cams receiving the butts of the guide needles of said both sets; two concentrically arranged annular guide bars having grooves receiving the guide needles of both sets; racking mechanisms for racking the annular guide bars along the front of said knitting needles; rotatable casings concentrically arranged over said needle cylinder, said rotatable casings carrying said annular guide bars and being operatively connected to respective ones of the racking mechanisms; rocking mechanisms for rocking respective ones of said sets of guide needles between said knitting needles; said guide needle rocking mechanisms including respective sliding frames, said sliding frames being arranged over said needle cylinder coaxially therewith and carrying the annular cams receiving the butts of the guide needles.

2. A circular warp knitting machine comprising: a bed; a needle cylinder fixedly mounted on said bed; knitting needles which are caused to reciprocate vertically arranged around said needle cylinder and each having a butt and a shank; a mechanism for vertically moving said knitting needles; a holder movable along said needle cylinder connected to said mechanism for vertically moving the knitting needles, said holder being arranged outside said needle cylinder and carrying said knitting needles mounted therein, said knitting needle carrying holder being formed by two concentrically arranged sleeves and having two longitudinally extending portions, an annular groove being provided in the outer sleeve to receive the butts of the knitting needles and grooves being provided on the inner sleeve to receive the shanks of the knitting needles, and wherein said mechanism for vertically moving the knitting needles includes a crank gear having a crankshaft adapted to be mounted on a main shaft of the machine, a rotatable frame connected to the crankshaft of the crank gear, legs mounted on said rotatable frame, each leg being connected to a respective portion of said holder by a link and a rod which are articulated to each other and one of said legs being mounted on said rotatable frame by means of a sliding key, and a device for moving said one leg along said rotatable frame; a main shaft of the machine to which said crankshaft is mounted; radially movable sinkers having butts; an annular cam, the butts of said sinkers being received in said annular cam; a sinker cup installed inside said needle cylinder and having grooves accommodating said sinkers; a sleeve movable along said needle cylinder, said sleeve being arranged inside the needle cylinder and carrying in the upper portion thereof said annular cam receiving the butts of the sinkers, the lower portion of the sleeve being connected to said main shaft of the machine to impart radial motion to the sinkers; two sets of guide needles having butts; annular cams receiving the butts of the guide needles of said both sets; two concentrically arranged annular guide bars having grooves receiving the guide needles of both sets; racking mechanisms for racking the annular guide bars along the front of said knitting needles; rotatable casings concentrically arranged over said needle cylinder, said rotatable casings carrying said annular guide bars and being operatively connected to respective ones of the racking mechanisms; rocking mechanisms for rocking respective ones of said sets of guide needles between said knitting needles; said guide needle rocking mechanisms including respective sliding frames, said sliding frames being arranged over said needle cylinder coaxially therewith and carrying the annular cams receiving the butts of the guide needles.

3. A machine according to claim 2, wherein the device for moving the leg along the rotatable frame comprises: a drive shaft connected by means of a gear train to said main shaft of the machine; a Geneva mechanism having its drive wheel secured to said drive shaft, a shaft of a driven wheel carrying a cam controlling the movement of the leg; said control of the leg movement being effected by means of a double-arm lever engaging the cam of the driven wheel shaft; a link operatively connected to said rotatable frame; a rocking slot hole member having a slider comprising a pin which is secured to said leg, the leg being elastically biased against a stop secured to said rotatable frame.

4. A circular warp knitting machine comprising: a bed; a needle cylinder fixedly mounted on said bed; knitting needles which are caused to reciprocate vertically arranged around said needle cylinder; a mechanism for vertically moving said knitting needles; a holder movable along said needle cylinder connected to said mechanism for vertically moving the knitting needles, said holder being arranged outside said needle cylinder and carrying said knitting needles mounted therein; a main shaft of the machine; radially movable sinkers having butts; an annular cam, the butts of said sinkers being received in said annular cam; a sinker cup installed inside said needle cylinder and having grooves accommodating said sinkers; a sleeve movable along said needle cylinder, said sleeve being arranged inside the needle cylinder and carrying in the upper portion thereof said annular cam receiving the butts of the sinkers, the lower portion of the sleeve being connected to said main shaft of the machine to impart radial motion to the sinkers; two sets of guide needles having butts; annular cams receiving the butts of the guide needles of said both sets; two concentrically arranged inner and outer annular guide bars having grooves receiving the guide needles of both sets; racking mechanisms for racking the annular guide bars along the front of said knitting needles; rotatable casings concentrically arranged over said needle cylinder, said rotatable casings carrying said annular guide bars and being operatively connected to respective ones of the racking mechanisms; rocking mechanisms for rocking respective ones of said sets of guide needles between said knitting needles; said guide needle rocking mechanisms including respective sliding frames mounted in guides of said bed, said sliding frames being arranged over said needle cylinder coaxially therewith and carrying the annular cams receiving the butts of the guide needles, said rocking mechanism for rocking the guide needles including a drive shaft operatively connected to said main shaft, a motion imparting member mounted on said drive shaft, said sliding frame of each respective rocking mechanism of the guide needles being articulated to said motion imparting member by means of a link, an arm and a connecting rod and wherein each rocking mechanism for rocking the guide needles comprises devices for retaining the guide needles in said grooves of said annular guide bar, said device for retaining the guide needles in the inner annular guide bar including a fixed axle, a spring-biased plate secured to said fixed axle coaxially with the inner annular guide bar which has a toroidal surface, said spring-biased plate bearing with the edge thereof against the toroidal surface of the inner annular guide bar, and said device for retaining the guide needles in the outer annular guide bar including two superposed rings embracing the outer annular guide bar, each of said rings having internally a toroidal surface and externally an arm, and springs interconnecting said arms and effecting the elastic bias of the rings against one another and against the toroidal surface of the outer annular guide bar.

5. A circular warp knitting machine comprising: a bed; a needle cylinder fixedly mounted on said bed; knitting needles which are caused to reciprocate vertically arranged around said needle cylinder; a mechanism for vertically moving said knitting needles; a holder movable along said needle cylinder connected to said mechanism for vertically moving the knittng needles, said holder being arranged outside said needle cylinder and carrying said knitting needles mounted therein; a main shaft of the machine; radially movable sinkers having butts; an annular cam, the butts of said sinkers being received in said annular cam; a sinker cup installed inside said needle cylinder and having grooves accommodating said sinkers; a sleeve movable along said needle cylinder, said sleeve being arranged inside the needle cylinder and carrying in the upper portion thereof said annular cam receiving the butts of the sinkers, the lower portion of the sleeve being connected to said main shaft of the machine to impart radial motion to the sinkers; two sets of guide needles having butts; annular cams receiving the butts of the guide needles of said both sets; two concentrically arranged annular guide bars having grooves receiving the guide needles of both sets; racking mechanisms for racking the annular guide bars along the front of a respective knitting needles; rotatable casings mounted in guides of the bed and concentrically arranged over said needle cylinder, said rotatable casings carrying said annular guide bars and being operatively connected to respective ones of the racking mechanisms, each rotatable casing being articulated by means of a link to said racking mechanism; each of said racking mechanisms including a cam provided with change cam plates, the cam being formed by a sleeve integral with a plate on which are adjustably secured the change cam plates, the working surface of one of the cam plates having a radius greater than the radii of the working surface of other cam plates, a drive shaft, said cam being mounted on said drive shaft, a spring-biased double-arm lever having a roller for engaging said cam at one arm thereof, the other arm of the lever being connected to said link, the cam plate having the greater radius working surface having a projection and comprising two portions having radially mating planes which are substantially parallel and extend at an angle to said drive shaft so that the projection of one portion of the cam plate can be brought in the zone of the projection of the other portion of the cam plate; rocking mechanisms for rocking respective ones of said sets of guide needles between said knitting needles; said guide needle rocking mechanisms including respective sliding frames, said sliding frames being arranged over said needle cylinder coaxially therewith and carrying the annular cams receiving the butts of the guide needles.

* * * * *